United States Patent [19]

John

[11] Patent Number: 4,490,658

[45] Date of Patent: Dec. 25, 1984

[54] CIRCUIT FOR AUTOMATICALLY SEQUENCING A VALVE MECHANISM

[75] Inventor: Robert S. John, Deerfield, Ill.

[73] Assignee: International Telephone and Telegraph Corporation, New York, N.Y.

[21] Appl. No.: 427,969

[22] Filed: Sep. 29, 1982

[51] Int. Cl.[3] ..... G05B 11/18

[52] U.S. Cl. ..... 318/484; 318/467; 318/490

[58] Field of Search ..... 318/467, 468, 484, 490, 318/603

[56] References Cited

U.S. PATENT DOCUMENTS

| | | | |
|---|---|---|---|
| 3,257,598 | 6/1966 | Settles | 318/467 X |
| 3,394,292 | 7/1968 | Flum | 318/468 X |
| 3,780,360 | 12/1973 | Hempell | 318/467 X |
| 3,881,144 | 4/1975 | Kikuchi | 318/467 X |
| 3,914,676 | 10/1975 | Madonian | 318/467 |
| 3,928,846 | 12/1975 | Arai | 318/467 X |

*Primary Examiner*—J. V. Truhe
*Assistant Examiner*—Bentsu Ro
*Attorney, Agent, or Firm*—James B. Raden; Edward J. Brosius

[57] ABSTRACT

A solid state circuit for sequencing a valve mechanism from its normal operating position through a sequence of cycles to blow down various different lines of the network to which the valve mechanism is connected. The circuit may be set to initiate its sequence at one of a number of time periods such as once a day or once a week. Once initiated, the circuit operates a motor drive for the valve mechanism continuing for a timed interval followed by a delay or dwell at each blow down position. A signal is provided to indicate that the circuit is about to enter a blow down sequence followed by the sequence itself. Various alarms and safeguards are provided for the sequence.

5 Claims, 10 Drawing Figures

CIRCUIT FOR AUTOMATICALLY SEQUENCING A VALVE MECHANISM

BACKGROUND OF THE INVENTION

The invention is primarily directed to the automatic operation of a valve mechanism of the type shown by the co-pending patent application of J. Piper filed on July 13, 1982 under Ser. No. 397,685, the substance of that application being incorporated here by reference.

In the cited application there is shown a valve mechanism for use in an equalizing network of a boiler system. The valve mechanism is located at the junction of the intermediate line of the network, the return line and a blow down line. Normally this intermediate line houses the low water cutoff control. In the normal position of the valve mechanism, the intermediate and return lines are in open communication with one another and the drain path to the blow down line is blocked.

In a blow-down or cleaning sequence as explained in the cited reference application, the system operation such as burner and fuel supply are shut off. The valve mechanism may be stepped in a first cycle from the normal position to the first drain position in which the intermediate line is in open communication with the drain line for blow down of the intermediate line. The valve mechanism is then stepped in a second cycle to the next position to place the return line in open communication with the drain line. The mechanism is then stepped to the next position in which both the intermediate and return lines are open to the drain line. The mechanism is then stepped in a final cycle back to the normal operation position.

BRIEF SUMMARY OF THE INVENTION

The present invention is directed to a solid state circuit for controlling the operation of a valve mechanism through a series of motor drive operative steps to provide blow down sequences for the boiler system.

The circuit includes a clock driven from a standard 120 volt A.C. source. The clock may be set to produce an output at intervals such as every 8 hours (once per shift), every 24 hours (once per day), or every 168 hours (once per week). The output once produced initiates a sequence including four cycles of motor operation, with a delay or dwell at the conclusion of each motor operation at a position other than the normal position.

In the circuit, a cycling switch controls a sector timing circuit which initiates the start of the motor operation. The motor stops its stepping or rotation when the 90° switch indicates that one of the four valve mechanism positions has been reached. The sector timing controls the duration of the cycle comprised of the combined motor step plus dwell delay at each position. When the mechanism has returned to the normal position, a 360° switch closes to terminate the motor operation and inactivate the outputs from the sector timing.

Within the system, safeguards and alarm circuits monitor the valve mechanism movements and restoration to the normal position.

DETAILED DESCRIPTION

Figure 1:
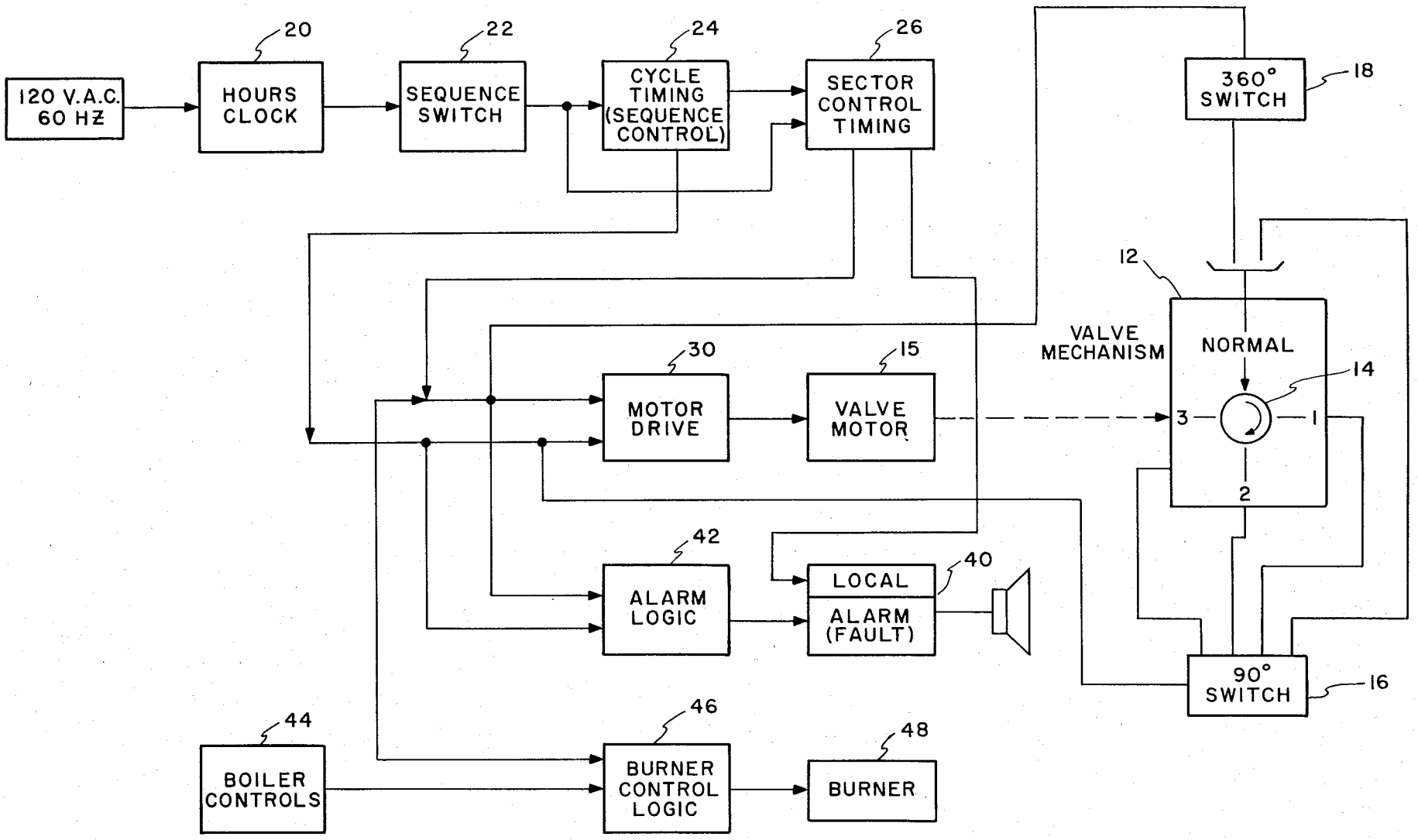
FIG. 1 is a schematic block diagram of the circuit of the present invention.

FIG. 1 shows the schematic block diagram of a control circuit for operating a valve mechanism 12 of the type shown in detail in the cited application. The valve mechanism 12 has a shaft 14 rotatable from its normal or home position through four cycles, each encompassing 90° of valve shaft rotation. The shaft is rotated by a motor 15. The motor 15 is a high torque low speed motor whose output is geared down by a conventional gear mechanism (not shown) to a speed of one revolution per 20 seconds.

The motor is controlled by limit switches 16 for 90° and 18 for 360° of rotation of the valve shaft. The motor once energized opens switches 16 and 18, and continues its rotation until 90° of rotation of the valve shaft is reached at which time the motor is de-energized by conventional power drive circuits (not shown) when the limit switch 16 closes. At each 90° position, the circuit produces a dwell or delay for the settable time interval. At the end of the dwell period, a second rotation cycle of 90° of valve shaft rotation is instituted. Switch 16 again re-opens and the valve shaft is rotated 90° at which time the motor operation stops when switch 16 closes, and the motor remains inactive for the dwell interval. Further, cycles occur automatically under control of the circuit of FIG. 1 until a four cycle sequence is completed at which time, the 90° switch 16 closes and the 360° switch 18 also closes.

The circuit of FIG. 1 is powered by a conventional 120 volt, 60 Hz AC source. The source voltage powers a multiple stage electronic clock 20 with multiple hour settings for up to 255 hour periods possible. By setting the clock, periods between blow down sequences may be selected in hours, or days up to ten days. It is preferable that the settings once made at the factory are not subject to change in the field.

A selected clock output triggers a sequence switch 22 which latches the circuit in operation for a sequence of four 90° rotations of the valve shaft with a cycle timing unit 24 to control the cycling of the valve mechanism and a sector control 26 to control the individual steps within a cycle. The sector control is settable to produce a time delay which may range from about 2 to 20 seconds at each 90° stop.

Motor drive control 30 is responsive to the cycle and sector timing to drive the valve motor. The timing signals also provide inputs for the alarm logic 42 for audible or visual alarm devices 40.

In a boiler system, the boiler is supplied through a boiler feed pump and burner controls 46 which control the actual burner 48. The control logic 46 will act to shut off the burner and feed when a sequence starts and will not reset until a sequence is properly terminated as signalled by the 90° switch and 360° switch, and by proper operation of the low water cutoff control.

Figure 2A:
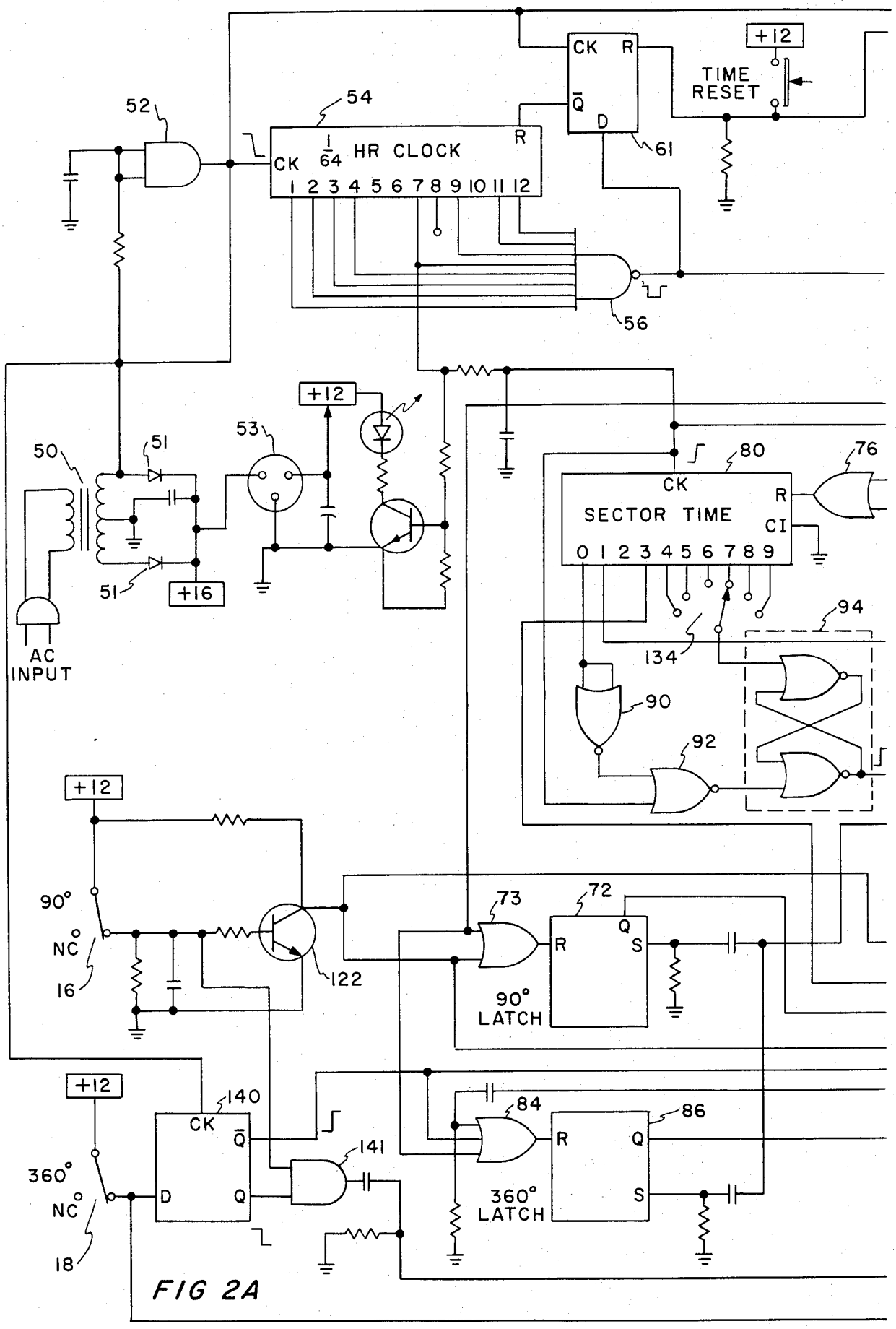
FIG. 2 is a block diagram showing the relative positions of FIGS. 2A, 2B and 2C to form a detailed schematic ensuring of the circuit of FIG. 1.
Figure 2B:
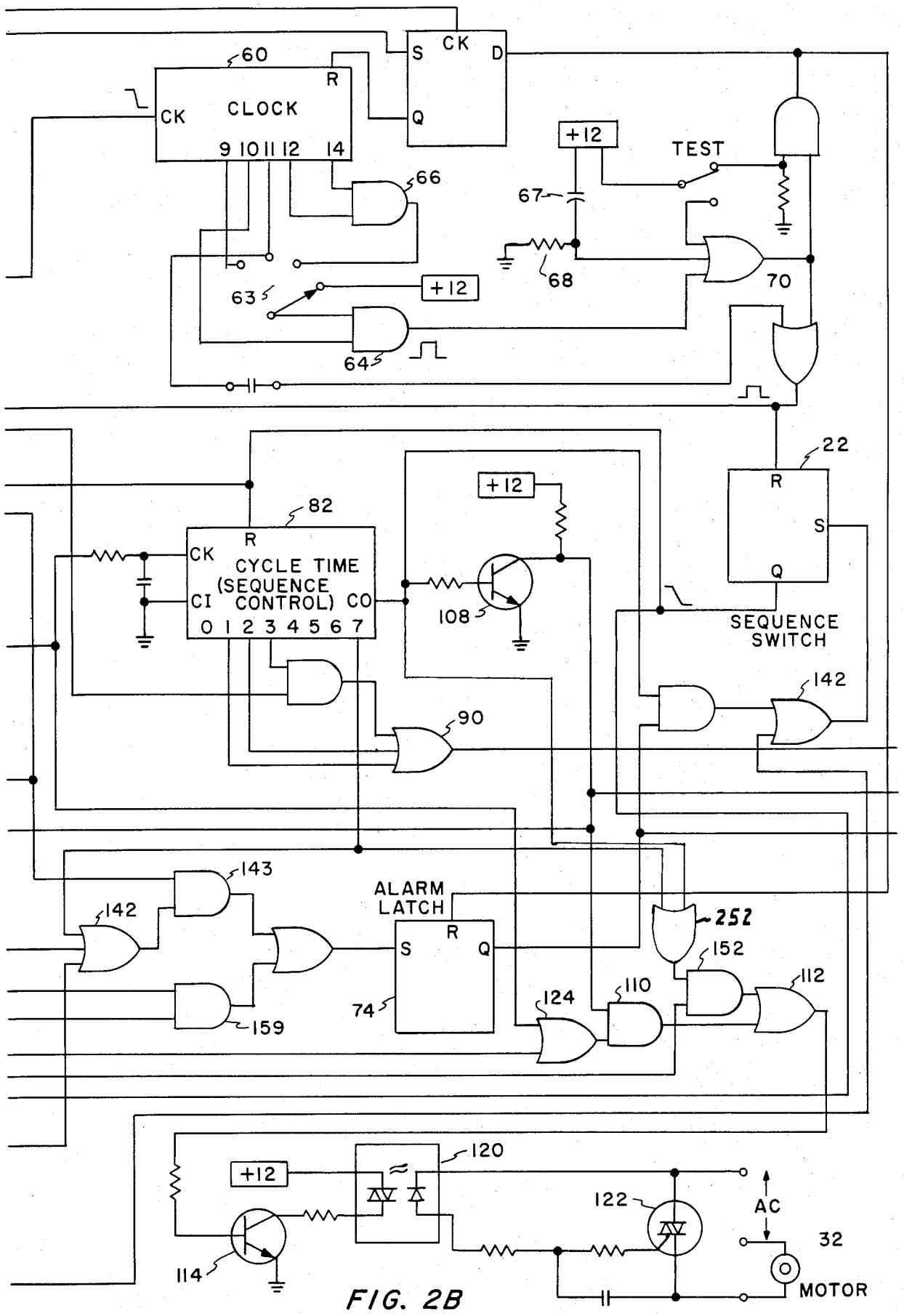
Figure 2:
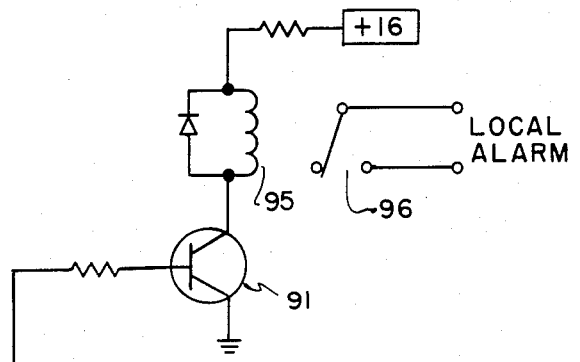
Figure 2:
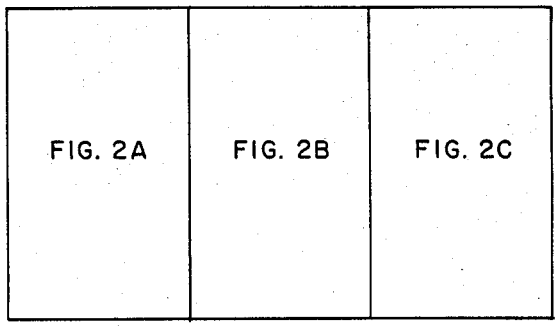

FIG. 2 is a more detailed showing of the valve operating, control and alarm circuit shown generally in FIG. 1.

The circuit of FIG. 2 is powered by a conventional source of 120 volt, 60 Hz AC fed to the primary of transformer 50. Transformer 50 is a step down transformer, the secondary voltage of which is rectified by full wave rectifier 51. The DC output is regulated in voltage regulator 53 to provide a 12 volt DC supply. An unregulated sixteen volt DC supply is also produced. At the transformer secondary, a signal is transmitted through pulse shaper gate 52 to the clock input of the first stage 54 of the clock 20. This clock 20 includes a twelve bit binary ripple counter 54 as the first stage of the clock, a NAND gate 56 and reset flip flop 61, which form a 1/64 hour clock (56¼ sec) by performing a divide by 3375 function.

Outputs of the counter 54 form the multiple inputs of NAND gate 56 whose output is directed to the clock input of the second stage counter 60 of clock 20. Counter 60 is a fourteen bit ripple carry binary counter/divider. The output of NAND gate 56 is also transmitted every 56¼ seconds to the D input of the reset flip-flop 61, as will be explained later.

Counter 60 provides outputs at multiples of ¼ hour so that by properly cross connecting its output terminals at switch 63, various time periods between sequences can be set. Some practical settings are 8 hours, 12 hours, 24 hours, 168 hours (once a week) and two 8 hour periods per day.

For eight hours, the #10 output of clock counter 60 is connected to one input of AND gate 64 while the other input is connected to the +12 volt source. For twelve hour setting, the #10 output is connected to the same AND gate input while the #9 output is connected to the other input of AND gate 64 in place of the direct power source. For a twenty-four hour sequence, the #10 output is connected to one input of AND gate 64 while the #11 output is connected to the other AND gate input. For the once a week setting, AND gate 66 is used for the #12 and #14 outputs, and the gate output is fed to one input of gate 64 with output #10 of the counter 60 connected to the other input of AND gate 64. For a sequence every eight hours but only twice per day (two work shifts) the #10 and #11 outputs are connected to the AND gate 64 inputs with an OR gate connection (not shown) from #11 output.

In operation, when a sequence operating output has been reached by clock counter 60 a pulse is transmitted through gate 64 and OR gate 70 to reset the RS flip-flop sequence switch 22 to the reset input of 90° latch 72 through OR gate 73, and to the reset input of 360° latch 86 through OR gate 84.

The sequence switch 22 is a 3 state NOR R/S latch which responds to the signal on its set input to produce a high signal on its Q output, as will be explained later. This high signal is transmitted through OR gate 76 to the Reset input of the sector timer 80, to the reset input of cycle timer 82, and through OR gate 84 to the reset input of 360° latch 86, to lock out these functions except during a cycle sequence. When clock counter 60 produces its output pulse, this signal is applied to the reset input of sequence switch 22 to produce a low signal on its Q output to enable the operating of sector timer 80 and cycle timer 82. The clock counter 60 output pulses also reset the 90° latch 72 and 360° latch 86, if in fact these latches were not previously reset.

Once the sector time 80 is no longer held in reset, it is clocked at a 2 2/15 second rate over its clock input lead from the #7 output of clock 54. When the sector timer is clocked to its chosen Q output, a path through NOR gates 90 and 92 sets latch 94. An output pulse from latch 94 results, which resets the sector timer 80 to begin a new sector timing period.

Each time the sector timer is clocked through its #1 output, cycle timer 82 is in turn clocked by the resulting pulses at the rate of 2 2/15 seconds times the division number set up by the choice of Q output in sector timer 80. The resulting time period also defines the valve driving plus dwell times. The first such pulse advances the cycle timer 82 to its #1 output, and initiates a pre-sequence alarm. The second and third pulses advance the cycle timer to its #2 and #3 outputs, continuing the presequence alarm.

Figure 4:
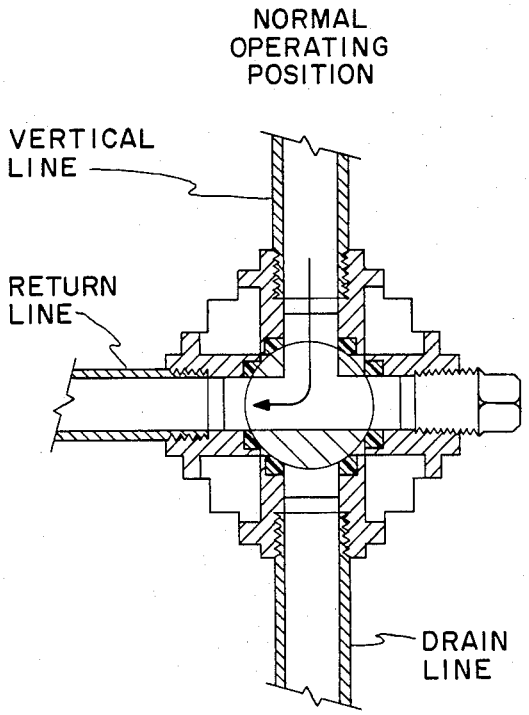
FIGS. 4–7 are schematic diagrams of the valve positions for the successive steps of the sequence herein described.

This alarm is generated with the valve mechanism in its normal position of FIG. 4 to indicate that a blow-down sequence is about to start. The alarm path may be followed from the 1 output of the cycle timer 82 through OR gate 90, transistor 91 and preliminary warning relay 95. The relay activates its contacts 96 to actuate an external audible and/or visual signal. The cycle timer is then stepped to its #2 output to continue the preliminary warning. When the cycle timer steps to its #3 output, this output is applied to AND gate 102, which also receives a square wave clock signal from #7 output of clock counter 54. The resulting intermittent signal from AND gate 102 is then also applied to the input of OR gate 90.

When the fourth stage output of cycle timer 82 is reached, (see timing chart of FIG 3) the relay 95 is inactivated and the pre-sequence warning is terminated. At the start of the #4 output of cycle timer 82, a carry out signal is generated on the CO lead to timer 82 to take transistor 108 out of conduction to produce a signal on one input of AND gate 110. The second input to this gate is sent from the #1 output of sector timer 80 via OR gate 124. With both input signals occurring, a motor drive signal is generated at gate 110, through OR gate 112, transistor 114, and the gate of the optical triac driver 120. The triac output in an AC circuit activates triac 122 and motor 32. The signal from transistor 108 is also sent to set the 90° latch 72 and to actuate alarm relay 162, by way of transistor 164. The motor once energized remains energized under the control of its 90° switch signal from transistor 122 via the second input of OR gate 124.

Figure 5:
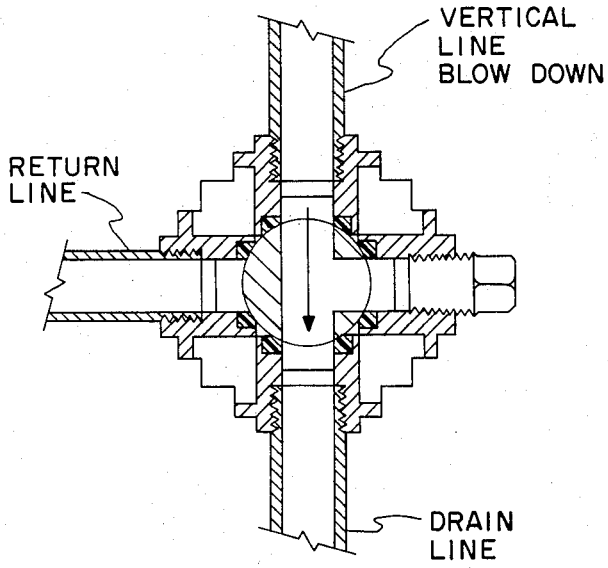

The duration of the signals from #1 output of sector timer 80 to AND gate 110 is less than that required for the valve to traverse 90° so that control of the motor operation passes to the 90° switch circuits once the motor operation has begun. The path for continued energization of the motor through the 90° switch may be traced from +12 volts through transistor 122, OR gate 124 and gates 110 and 112 and transistor 114 to the optical coupler 120 and to the motor drive triac. During motor operation, the 90° switch 16 opens. When the valve driven by the motor reaches its 90° position, the switch recloses. At that time, the sector timer has passed to its #2 output so the original operating path to the motor drive is opened. The sector timer 80 next provides a delay for an interval until sector timer reaches the output set by the manual switch 134. The set time may be from approximately six to twenty seconds. The valve mechanism remains at the first off-normal position to enable blow down of the vertical equalizing pipe as shown by FIG. 5. At this time, the cycle timer is at the #4 output signifying the first of four cycles.

Figure 3:
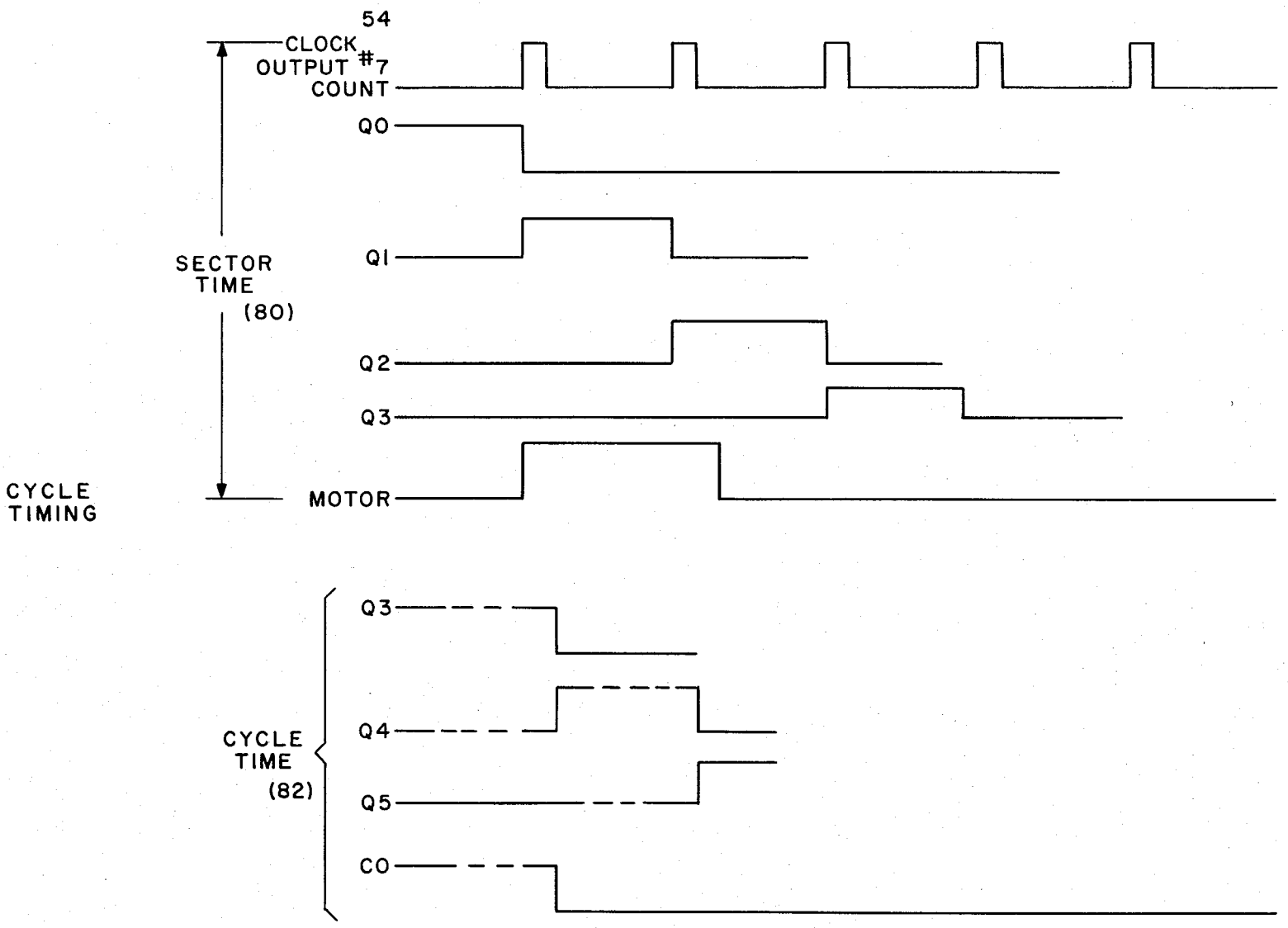
FIG. 3 is a cycle timing chart for outputs of the sector timing and cycle timing of FIG. 1.

At the end of the set delay period, the output through switch 134 at the sector timing output is sent to the latch 94 and OR gate 76 to reset the sector timing counter. The latch is reset to #0 at the selected Q output, and after one more clock input signal, the #1 output starts the motor drive. The cycle timer is stepped to its #5 output as the sector timer steps to its #1 output. Note that the CO output of cycle timer 82 remains active during cycle intervals 4–7 to provide a input to AND gate 110 through transistor 108. This signal on the CO lead provides the added input which allows the motor drive output from gates 110 and 112 to drive the motor. The motor once started operates until its self interruption at 90° of valve rotation. The sector timer continues to receive pulses from clock 54 output #7 to step through its cycle as shown by FIG. 3. This sector timer cycle provides the delay or dwell period during which the valve lower return pipe is blown down as viewed in FIG. 6.

At the set count, the delay period ends and the sector timer is reset. The sector timer initiates operation of the motor through the sector timer #1 output and clocks the cycle timer to the #6 output. The motor rotates the valve mechanism to the position of FIG. 7 placing both vertical and horizontal lines in communication with the drain line for the ensuing delay period as previously described.

Another similar cycle is initiated to step the vavle mechanism back to its normal position and to step the cycle timer to its #7 output. With the cycle timer stepped to its #7 output, and the valve mechanism rotated to normal, the 360° switch 18 re-closes. Closure of the switch places +12 volts on the D input of the 360° monitor flip-flop 140. When the flip-flop receives the D input, it produces a signal on its Q output to OR gate 142 to the S input of the cycle latch 22 to terminate the sequence by placing a reset input to the cycle timer 82 and sector timer 80.

A number of safeguards and alarms are provided through the use of the alarm logic 42 (FIG. 1) which constitutes the gating networks of FIG. 2B controlling the switches and relays of FIG. 3C. Of these, a number monitor the operation of the 90° switch. As a first of these, if the 90° switch does not open after the sector timing unit 80 has produced a motor drive output, an alarm is given. Further, if the 90° switch has not reclosed to indicate proper valve mechanism movement, an alarm is given.

A similar group of alarms is centered about the operation of the 360° switch. If the 360° switch does not open on origination of the blow down sequence, an alarm is triggered. If the switch does not restore on completion of the cycle an alarm is sounded and latched and boiler operation cannot occur until problem is corrected.

Further, whenever line power goes off and is restored, a blow down sequence is initiated automatically on the power restoration by the time delay in charging of capacitor 67 by current through resistor 68.

Of the safeguards and alarms, the 90° switch alarms will be discussed first. Repeating, if the 90° switch has not opened its contacts 16 FIG. 2A within the time interval during which the sector timing has reached its #3 output, an alarm signal is generated. If the 90° switch has not reclosed its contacts 16 before the sector timer reaches its output selected by switch 134, an alarm signal is generated.

The 90° latch 72 is set, to produce a high or true output on its Q output by the pulse from the CO output of cycle timer 82, via transistor 108. The Q output signal is applied to one input of AND gate 159. The other AND gate input is applied from the #3 output of sector timer 80. The 90° latch 72 remains set with its Q output high until the 90° switch 16 opens, at which time the output from transistor 122 becomes high, and the 90° latch is reset to low output via OR gate 73. If this does not occur before the #3 output of the sector timer, then both inputs to AND gate 159 are true, and a signal is applied to the set input of alarm latch switch 74 to energize alarm relay 162 through transistor 164. Opening to the 90° switch resets the 90° latch and removes its true input to the AND gate 159.

The 90° switch output from transistor 122 is also applied through OR gate 142 to one input of AND gate 143. The other AND input is taken from the selected Q output of sector timer 80. If the 90° switch remains open at the selected Q output time, then a signal is applied by the AND gate to set the alarm switch 74, as previously. Closing of the 90° switch removes its input to AND gate 143, preventing the set input to alarm switch 74.

The 360° switch operation is also safeguarded and alarmed, similarly to the 90° switch. Signals from the 360° switch 18 are applied to the D input of flip flop 140 to produce pulses synchronized with the 60 Hz clock. When the 360° switch opens at the start of a blowdown sequence, the signal at the D input of the flip flop changes from high to low voltage. A low signal results at the Q output and a high signal at the $\overline{Q}$ output of flip flop 140. The high output signal is applied to OR gate 84 to drive the reset input of 360° latch 86, which was previously set to high Q output by the signal from the CO output of cycle timer 82, via transistor 108, at the start of the valve mechanism rotating sequence. The latch 86 high Q output signal is applied to an input of OR 142 and thence to AND 143. As explained previously, the other AND 143 input is taken from the output of the sector timer 80, which goes high at the time of the selected Q output. At that time, if the Q output of the 360° latch remains positive, then the 360 switch action has failed to occur. These signal conditions result in latching of the alarm latch 74, actuating alarm relay 162 as explained previously. Similarly, when the cycle timer reaches its output #7, the alarm is latched if the cycle is not completed before the sector timer reaches its selected Q output.

The signal from $\overline{Q}$ output of flip flop 140 is also applied to AND gate 152, whose other input is taken from the #7 output of cycle timer 82. The AND gate output is applied to OR 112 and then to the motor drive circuit through transistor 114, as explained previously. The result of these connections is that the drive signal to the motor will continue until 360° switch 18 recloses again at the finish of the complete cycle. As explained previously, the motor drive signal is also maintained until the 90° switch 16 recloses after its final 90° traverse. Thus, the drive cycle is not complete until both switches have reclosed at the finish.

The 90° switch output is applied to one input of AND gate 141, the other input coming from the Q output of flip flop 140 from the 360° switch. When both switches have reclosed at the end of a cycle, their positive outputs into AND 141 produce a positive signal which is applied via OR gate 142 to the S input of sequence switch 22, to make its Q output go high, thus placing positive or high reset signals to stop the cycling and counting of sector timer 80 and cycle timer 82, thus ending the cycle timing sequence.

Figure 2C:
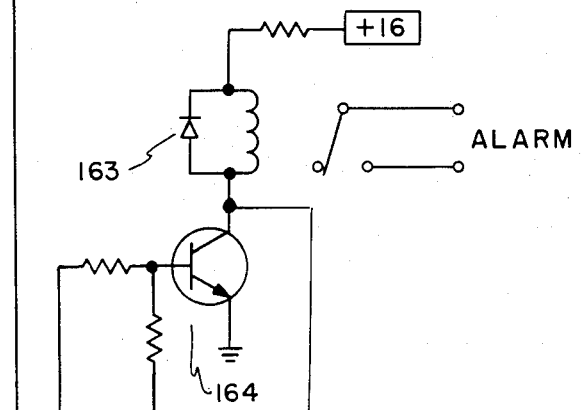
Figure 2C:
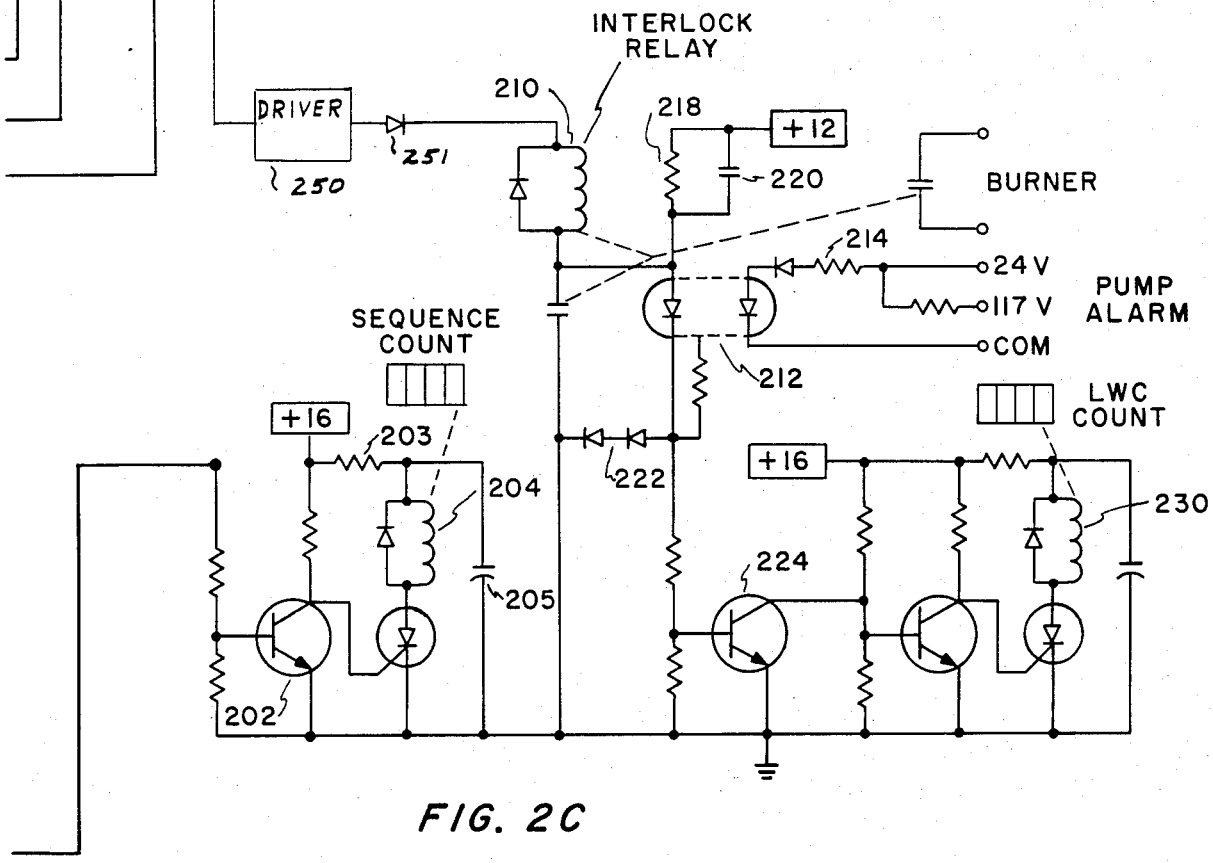

As the final actions based on the 360° switch operation, the switch output signal is applied to the sequence counter 204. In FIG. 2C, the switch signal is applied to transistor 202, holding it output at zero or low voltage whenever the switch contacts are closed. Transistor 202 output is applied to the gate input of a silicon controlled rectifier (SCR) whose output completes a circuit from capacitor 205 through the coil of sequence counter 204. A current is supplied from the +16 volt supply through resistor 203 to capacitor 205 which is in parallel circuit with the counter coil and SCR as shown. When the SCR is turned off (360° switch closed), the current through resistor 203 slowly charges capacitor 205 toward +16 volts. When the 360° switch opens, the resulting signals turn on the SCR, discharging the capacitor through the counter coil and advancing the sequence counter display by one count. When the capacitor is discharged, the 360° switch recloses, the SCR turns off, the current through resistor 203 being less than the holding current of the SCR. In this manner, the sequence counter advances one count for each blowdown cycle.

The signal from the alarm relay transistor 164 is also applied to the coil of interlock relay 210 which is in series with one of its normally open contacts in self-latching arrangement. The other normally open contact is externally connected in series with the boiler burner or fuel pump relay coils to enable their operation. When the relay 210 coil draws current through the transistor driver stage 250 and diode 251 from alarm transistor 164, the relay contacts both remain closed. When the alarm relay goes on, the current through the interlock relay coil 210 is interrupted. Both relay contacts open, thus disabling the interlock relay and the boiler burner or pump relays. The interlock relay can only be reactuated to enable the burner or pump by the proper operation of the boiler low water cutoff control, and by the release of the alarm relay.

During blowdown, water and steam are vented out through the valve to the drain line (see FIGS. 4 to 7). In normal installations, sufficient liquid will be vented to actuate the low water cutoff control installed elsewhere on the boiler. The burner contacts of this control will then open, and the pump or alarm contacts will close to apply power to a pump or alarm circuit. External leads are wired back from across the external pump or alarm actuator, and applied to the subject circuit as shown, to supply current through resistor 214 or resistors 214 and 216 in series, depending on the external voltage available. This current turns on the input LED of optocoupler 212, which then turns on the optical SCR of the optocoupler. The optical SCR draws a sufficient current from +12 volts through resistor 218 and capacitor 220 and diode array 222 to fully turn on and remain on. When the alarm relay restores after the blow down sequence, the interlock relay 210 can again draw current to operate through the optical SCR and diode array. At this time, the relay contacts reclose, thus reenabling the burner or fuel pump, and also shorting out the optical SCR and diode array to turn off the optical SCR until the next blowdown sequence.

While the optical SCR of the optocoupler 212 remains turned on, the current drawn through the circuit causes a voltage drop across the diode array 222. This voltage is applied to the input of transistor 224, in common emitter configuration circuit, causing its output to change from high to zero or low voltage. The transistor output is then applied to the input of the low water cutoff count circuit to operate the counter 230 in the same manner as described previously for the sequence counter 205. One count is added for the first operation of the low water cutoff which occurs during the blowdown sequence. At other times, the contacts of the interlock relay short out the optical SCR and diode array, so no signal can be present to cause a count to be added.

These counter actuations provide an important diagnostic function for the system. Normally, the sequence counter adds one count for each blowdown sequence, and the low water cutoff counter adds one count during blowdown. Normally then, logging and comparison of the counts will indicate that the low water cutoff control has operated, that the blowdown sequence has occurred properly, and that the boiler burner or fuel pump circuit is reenabled. If the low water cutoff fails to operate, possibly indicating a blocked float chamber or other fault condition, the burner interlock relay will not reclose to allow burner operation, and a count will not be added. If the control circuit fails in some mode, a sequence count will not be added and a low water cutoff count may or may not be added, depending on the particular circuit failure mode. By logging and analyzing the counts before and upon system failure, and the control circuit alarm status, the cause and time of occurrence of a system failure can be determined, to assist in repair operations.

An additional feature through OR gate 252 ensures that following a power outage, if the 360° switch is not closed, a path from the CO lead through gates 252, 152 and 112 to transistor 114 will operate the motor to return the valve to its normal position.

FIGS. 4–7 show the valve mechanism in its operative positions in the system of the cited Piper application. In FIG. 4, the valve is in the normal or home position, the position in which it would remain most of the time, recirculating fluid through the low water cut off line to the tank. FIG. 5 shows the valve mechanism at the end of the first motor operating cycle during the delay or dwell period with the cycle timer at the #1 output. The valve mechanism has rotated 90° from the normal position placing the intermediate line in communication with the drain line.

Figure 6:
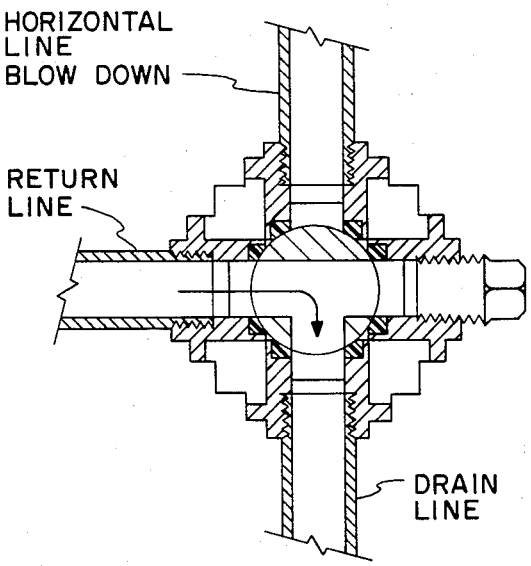

FIG. 6 shows the valve mechanism at the end of the second motor operating cycle in its dwell state. The valve mechanism has rotated 180° from normal placing the return line in open communication with the drain line.

Figure 7:
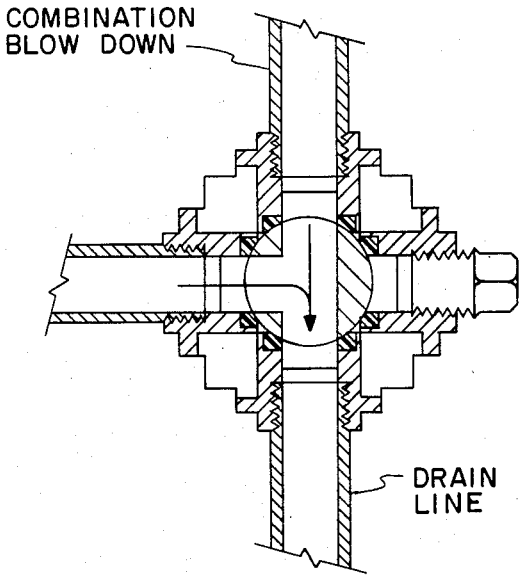

FIG. 7 shows the valve mechanism rotated 270° from its normal position in its delay which places both boiler lines in communication with the drain line. The showing of FIG. 7 is the final position before the motor returns the valve to the home position of FIG. 4. As mentioned, with the return of the valve mechanism to the home position of FIG. 4, 360° switch 18 recloses to allow re-operation of the system.

What is claimed is:

1. A circuit for controlling the operation of a rotatable valve mechanism through a sequence of cycled operations at selectable time intervals, comprising motor means for rotating said valve mechanism unidirectionally through successive cycles, and in which a sequence is comprised of rotation of the valve mechanism through arcs of predetermined extent from a normal position to successive intermediate positions and back to said normal position to complete a valve mechanism operating sequence, and in which each cycle comprises rotation of the valve mechanism from one position to the next in said sequence, first means operative on rotation of the valve mechanism away from the normal position for producing a lockout signal to operate a first output switch, said circuit including means for terminating the rotation of said valve mechanism at each position to terminate each cycle, means operative with the mechanism at an intermediate position for holding said mechanism at that intermediate position for a predetermined timed period, means responsive to the end of said timed period for energizing the motor means to rotate the valve mechanism to the next successive position, and means responsive to the valve mechanism reaching the next position for continuing said cycles of the mechanism until return of the mechanism to its normal position whereby to terminate said lockout signal and to restore said first output switch and end said sequence, in which said positions are disposed at 90° of arc from one another, and in which there is means for producing a signal whenever said valve mechanism is not in one of said positions, and in which there are alarm means operative whenever said valve mechanism is in its normal position and either of said signals is still being produced.

2. A circuit as claimed in claim 1, in which there is a latch which produces a further signal when a cycle is completed, and in which there is alarm means operated when said latch produces said further signal and either of said position signals is still being produced.

3. A control circuit for a motor actuated valve mechanism of the type in which said mechanism is capable of being actuated by a motor from a normal position in which the system of said valve mechanism is operative to successive other positions opening said valve mechanism in individual non-operative conditions of the system, said circuit including a clock timer for initiating motor actuated sequences of said valve mechanism at selected times, a sequence control circuit responsive to said timer for automatically initating a sequence for controlling said motor to move said valve mechanism out of said normal position to begin a sequence, a further timing circuit for timing cycles within said sequence with each cycle comprising the successive movement of the valve mechanism from one position to an adjacent position, an output of said sequence control circuit enabled by said timer to enable successive cycles of said further timing circuit, a selectable output path from said further timing circuit for setting the combined period of movement of said valve mechanisms to said next successive other positions and a period of dwell of the valve mechanism at said next other position, said further timing circuit productive of a timed output for operating said motor with said output of said sequence control circuit enabled, motor control means responsive to movement of said valve mechanism out of a position for maintaining said motor energized for a period long enough to move the valve mechanism to the next position, further motor control means for deenergizing said motor when said next successive position is reached, and in which there is means operative when said valve mechanism is restored to the normal position for producing a signal for terminating said sequence, and in which there is alarm means responsive to the failure of production of said last mentioned signal at the time when termination of a sequence has expired for generating an alarm.

4. A circuit apparatus for controlling the automatic operation of a motor driven rotary valve mechanism at a preset time through a sequence comprised of the steps of rotating said valve mechanism from a normal position to a first position, to a second position, to a third position and then back to said normal position, said circuit apparatus including clock timing means for automatically initiating a valve mechanism operating sequence, first switch means responsive to rotation of the valve mechanism from the normal position for inactivating a system containing the valve of said mechanism, a second switch means responsive to rotation of the valve mechanism from the normal position for preparing an alarm, third switch means responsive to rotation of the valve mechanism from any position to prepare a first alarm means with said first alarm means reset by the valve mechanism reaching its next position, a timing circuit for initiating the rotation of said valve mechanism to rotate said valve mechanism to the next position, said second switch means responsive to said valve mechanism reaching said next position for resetting to end said alarm preparation, second alarm means operative when said second switch mechanism has not reset following the end of the timed period for rotation to trigger an alarm, third alarm means for monitoring the return of the valve mechanism to the normal position, said third alarm means responsive to the expiration of a final timed period for returning said valve mechanism to its normal position when said second and/or third switch means have not reset their respective alarm means for causing an alarm to be initiated and for causing said first switch means to maintain the valve containing system in activated.

5. A circuit apparatus as claimed in claim 4, in which said third alarm means includes an interlock switch for monitoring the condition of the valve mechanism relative to the normal position and controlled from said second switch means, said interlock switch including self-latching means requiring manual reset.

* * * * *